US010125528B2

(12) United States Patent
Wypych et al.

(10) Patent No.: US 10,125,528 B2
(45) Date of Patent: Nov. 13, 2018

(54) EASY GLIDE STORM DOOR

(71) Applicant: Zdzislaw Stanislaw Wypych, Jackson, MI (US)

(72) Inventors: Zdzislaw Stanislaw Wypych, Jackson, MI (US); William Terrance Carless, Jackson, MI (US)

(73) Assignee: Zdzislaw Stanislaw Wypych, Jackson, MI (US)

( * ) Notice: Subject to any disclaimer, the term of this patent is extended or adjusted under 35 U.S.C. 154(b) by 100 days.

(21) Appl. No.: 14/874,733

(22) Filed: Oct. 5, 2015

(65) Prior Publication Data

US 2016/0097228 A1 Apr. 7, 2016

Related U.S. Application Data

(60) Provisional application No. 62/059,312, filed on Oct. 3, 2014.

(51) Int. Cl.
*E05D 15/06* (2006.01)
*E06B 3/46* (2006.01)

(52) U.S. Cl.
CPC ..... *E05D 15/0652* (2013.01); *E05D 15/0656* (2013.01); *E06B 3/4636* (2013.01)

(58) Field of Classification Search
CPC ..... E05F 2017/005; E05F 1/00; E06B 3/42; E06B 3/46; E06B 3/4618; E06B 3/4627; E06B 3/721; E06B 3/4609; E06B 3/4654; E06B 3/4636; E05D 15/0652; E05D 15/0656
USPC ..... 52/207
See application file for complete search history.

(56) References Cited

U.S. PATENT DOCUMENTS 923,706 A * 6/1909 Richey et al. ..... E05D 15/0613 16/103
1,036,589 A * 8/1912 Eggleston ..... E05D 15/0613 16/94 R
1,051,426 A * 1/1913 Matheson ..... 16/94 R
1,329,461 A * 2/1920 Frantz ..... E05D 15/0652 104/110
1,485,200 A * 2/1924 Roberts et al. ..... 16/96 R
1,689,665 A * 10/1928 Cramp ..... E05D 15/0639 16/103
1,791,527 A 2/1931 Hoffman
2,732,919 A * 1/1956 Johnson, Jr. ..... E05D 15/0652 16/90

(Continued)

OTHER PUBLICATIONS

Sliding Door Track C-412 KNC K.N. Crowder Mfg. Inc., 2 pages, dated May 27, 2015 http://www.kncrowder.com/slidingdoor/c412.php.

(Continued)

*Primary Examiner* — Brent W Herring
(74) *Attorney, Agent, or Firm* — The Dobrusin Law Firm, P.C.

(57) ABSTRACT

A method of installing a storm door is disclosed. The method includes the steps of: attaching a track to a door head; attaching one or more rollers to the track; and attaching the storm door to the one or more rollers. After the storm door is installed, the storm door can be slid along a length of the track between an open position and a closed position. While sliding the storm door between the open position and the closed position, the storm door remains generally parallel to the door head.

20 Claims, 4 Drawing Sheets

(56) References Cited

U.S. PATENT DOCUMENTS 2,761,172 A 9/1956 Jorgensen et al.
2,847,726 A * 8/1958 Frick ..... E06B 3/4609 49/380
3,039,153 A * 6/1962 Dusing ..... E05D 15/10 292/300
3,261,129 A * 7/1966 Brydolf ..... E05D 15/06 16/105
3,327,428 A * 6/1967 Horton ..... E05F 15/56 49/177
3,416,183 A * 12/1968 Martin ..... E05D 15/0691 16/105
3,473,266 A * 10/1969 Miller ..... E05D 15/06 16/87 R
3,480,989 A * 12/1969 Edeus ..... E06B 3/4636 16/94 R
3,611,637 A * 10/1971 Saino ..... E05D 15/1021 16/90
3,636,588 A * 1/1972 Ferris ..... E05D 15/0652 16/102
3,916,477 A 11/1975 Baker
4,081,880 A * 4/1978 Edeus ..... E05D 15/0656 16/87 R
4,325,204 A * 4/1982 Martine ..... E06B 3/4654 49/372
4,404,770 A * 9/1983 Markus ..... E05D 15/1021 49/235
4,424,605 A * 1/1984 Squires ..... E05D 15/0652 16/94 R
4,452,014 A * 6/1984 Markus ..... E05F 15/646 49/360
4,488,387 A * 12/1984 Foti ..... E06B 7/22 49/425
4,513,535 A * 4/1985 Uphoff ..... E06B 3/4636 49/409
4,633,614 A * 1/1987 Van Weelden ..... A47K 3/34 16/105
4,651,469 A * 3/1987 Ngian ..... E05D 15/1021 16/87 R
4,680,828 A * 7/1987 Cook ..... E05D 15/0634 16/102
4,742,645 A * 5/1988 Johnston ..... E06B 3/4654 49/372
4,881,346 A * 11/1989 Block ..... E06B 3/721 49/409
4,936,049 A * 6/1990 Hansen ..... E05D 15/565 49/209
5,079,872 A * 1/1992 Short ..... A47K 3/34 4/557
5,301,468 A * 4/1994 Kamezaki ..... E05D 15/1021 49/209
5,351,442 A * 10/1994 Gingras ..... E05D 15/1042 49/411
5,450,693 A * 9/1995 Tarrega ..... E05D 13/04 49/409
5,461,829 A * 10/1995 Lehto ..... E05D 15/1021 16/87 R
5,566,505 A * 10/1996 Kamezaki ..... E05D 15/1021 49/209
5,742,979 A * 4/1998 Garcia-Hernando ..... E05D 15/066 16/100
6,082,499 A * 7/2000 O'Donnell ..... E05D 15/12 16/87 R
6,250,016 B1 * 6/2001 Gravel ..... B60P 7/14 49/306
6,289,643 B1 * 9/2001 Bonar ..... E06B 3/4654 49/505
6,336,247 B1 1/2002 Schnoor
6,647,590 B2 11/2003 Haab et al.
6,871,448 B1 * 3/2005 Kline ..... E06B 7/28 49/319
7,712,258 B2 * 5/2010 Ewing ..... E05C 7/06 16/105
7,743,557 B2 * 6/2010 Liao ..... E05D 15/0652 16/95 R
7,779,578 B2 * 8/2010 Gray ..... E06B 3/01 49/409
8,443,549 B2 * 5/2013 Salvietti ..... E05D 15/48 49/118
8,579,006 B2 * 11/2013 Levin ..... E04B 2/827 160/184
8,584,317 B2 11/2013 Liebscher et al.
9,145,730 B1 * 9/2015 Santamaria ..... E06B 5/11
2002/0104373 A1 * 8/2002 Ishihara ..... E05F 15/44 340/556
2005/0000164 A1 * 1/2005 Jacobs ..... E05D 15/0669 49/425
2005/0235571 A1 * 10/2005 Ewing ..... E05C 7/06 49/410
2006/0277850 A1 12/2006 Gravel et al.
2007/0283640 A1 * 12/2007 Shivak ..... E04B 2/7455 52/207
2018/0023336 A1 * 1/2018 Groff ..... E06B 3/4636
2018/0148966 A1 * 5/2018 Sakabe ..... E05D 15/06

OTHER PUBLICATIONS

Pocket Door Rollers Center Hung, BB 163208 Ball Bearing Hanging Door Hardware, 13 pages, dated May 27, 2015 http://hangingdoorhardware.com/pocketdoors/pocketrollers.htm.

Sliding Door Weatherstrip Brush Seals, Weather Proof Designs Hanging Door Hardware, 3 pages, dated May 27, 2015 http://hangingdoorhardware.com/pocketdoors/weatherstrip/weatherstrip.htm.

* cited by examiner

EASY GLIDE STORM DOOR

FIELD

These teachings relate generally to a closure for a passage such as the entrance to a living space, and in particular to a storm door positioned in front of a main door.

BACKGROUND

A house or apartment generally includes a storm door having glass panels and window screen panels in front of an exterior door. The storm door provides visibility outside of the exterior door through the glass or screen panels, and allows ventilation through the window screen panels. Also, the storm door protects the exterior door from bad weather and thereby helps to prevent infiltration from a strong rush of wind or rain.

Typically, a storm door has the general appearance of a swinging door; that is a door panel suspended on hinges within a door frame. When a person standing outside opens the storm door, the storm door swings on the hinges toward the person so that the person must back away from the opening. This outward swinging action of the typical storm door requires there to be a clear space in front of the doorway equal to about the width of the storm door. In areas where snow is prevalent, snow builds up in front of the door making it difficult or in extreme cases, impossible to open the door. For instance, a 36" prior at storm door must displace 36" distance of swing worth of snow. It is not unheard of where a person must use a different exit from their home and then must shovel clear their storm door so it will open.

When a prior art storm door is located at the to of a set of stairs, a person opening the storm door must step backward, usually descending as step or two, in order to provide the needed swinging clearance for the storm door open. Stepping backward on a set of stairs can be awkward, especially for the elderly, the infirm and the very young. This difficulty is compounded if the person is carrying groceries or other objects.

Another difficulty encountered with prior art storm doors is prompted by the common return spring system fitted to swinging storm doors. A person attempting to enter through a doorway closed by both s storm door and a main door must hold the storm door open against its return spring with their elbow, hand or body. This action can be especially cumbersome for a person with a physical handicap or carrying as load.

Furthermore, a prior art storm door sometimes can be caught by gusts of wind, which may cause severe damage to the door and/or the door jamb to which it is hinged.

There is therefore a need for an improved storm door that tat overcomes these shortcomings found in prior art storm door systems.

SUMMARY

A method of installing a store a door is disclosed. The method comprises one or more steps including: attaching a track to a door head; attaching one or more rollers to the track; and attaching the storm door to the one or more rollers. After the storm door is installed, the storm door can be slid along a length of the track between an open position and a closed position. While sliding the storm door between the open position and the closed position, the storm door remains generally parallel to the door head.

A method is disclosed comprising the steps of retrofitting a swinging storm door into a storm door that slides comprising one or more steps of: attaching a wall bracket to a door bead; attaching a track to the wall bracket; attaching one or more rollers to the track; attaching a door bracket to the swinging storm door; and attaching the door bracket to the one or more rollers. After the door bracket is attached to the one or more rollers, the storm door can be slid along a length of the track between an open position and a closed position. After the door bracket is attached to the one or more rollers, the storm door is restricted from swinging.

An assembly is disclosed, comprising: a wall bracket configured to attach to a door head; a track connected to the wall bracket; a roller fit within the track so that the roller is moveably connected to the track; a door bracket connected to the roller so that the door bracket moves with the roller during sliding; a lower guide attached to a bottom sill and slidably receiving at least a portion of a storm door; and a top guard attached to a portion of the storm door and the track so that a gap defined between the storm door and the track is closed out. The roller can be slid within the track so that the storm door can be slid along a path that is generally parallel to the door head and is restricted from swinging relative to the door head.

DETAILED DESCRIPTION

The explanations and illustrations presented herein are intended to acquaint others skilled in the art with the teachings, its principles, and its practical application. Those skilled in the art may adapt and apply the teachings in its numerous forms, as may be best suited to the requirements of a particular use. Accordingly, the specific embodiments of the present teachings as set forth are not intended as being exhaustive or limiting of the teachings. The scope of the teachings should, therefore, be determined not with reference to the above description, but should instead be determined with reference to the appended claims, along with the full scope of equivalents to which such claims are entitled. The disclosures of all articles and references, including patent applications and publications, are incorporated by reference for all purposes. Other combinations are also possible as will be gleaned from the following claims, which are also hereby incorporated by reference into this written description.

This disclosure claims priority to U.S. Provisional Patent Application No. 62/059,312 filed on Oct. 3, 2014, the contents of which is hereby incorporated by reference herein in its entirety for all purposes.

The present invention provides an improved storm door that overcomes the disadvantages present in prior art swinging storm doors. The improved storm door of this invention can be used without requiring a swing space. The improved storm door can be easily opened even by a person carrying groceries or who is physically handicapped. Furthermore, the improved storm door remains parallel to a wall of the dwelling, such that wind is less likely to catch and thrust open the storm door. The present invention can be installed as a retrofit item in an existing door opening with minimum modification.

Figure 1:
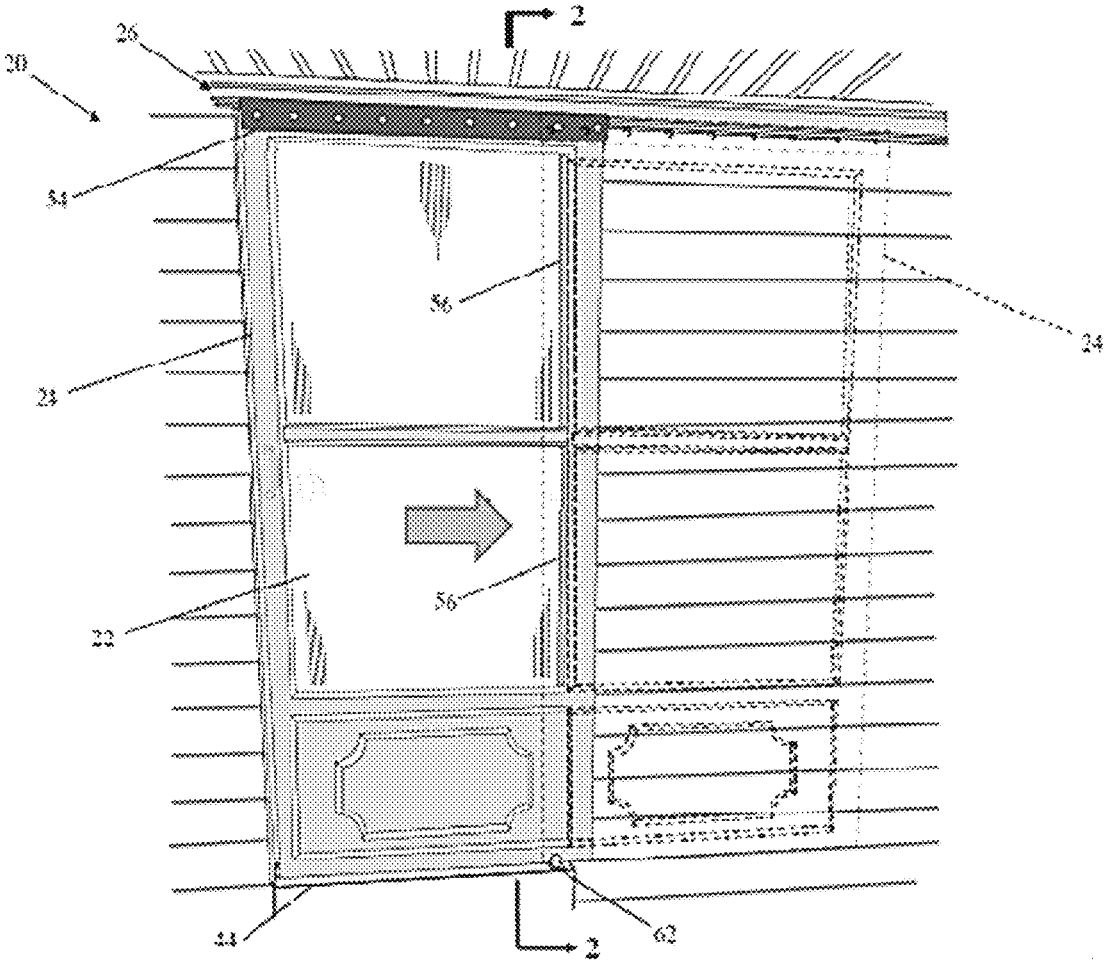
FIG. 1 is a perspective view of the easy glide door assembly in front of a standard exterior entry door

Referring to FIG. 1, an easy glide storm door assembly according to one exemplary embodiment of the invention is generally shown at 20 installed in front of a standard exterior entry door 22. The door assembly 20 comprises as door 24. One exemplary of the door 24 is shown having glass panels which are replaceable with screen panels. The shape and arrangement of the door 24 could, however, be of any suitable type and may or not may not correspond to the shape of the exterior door 22. The door 22 is suspending from above by a roller track system, generally indicated at 26. The door 24 is thus configured to slide to one side following in the roller track system 26 so that the user does not need to step back in order to open the door 24. The door 24 can therefore slide easily to one side, and stay in the open condition without further restraint, thus permitting easy and total access to the exterior door 22.

Figure 2:
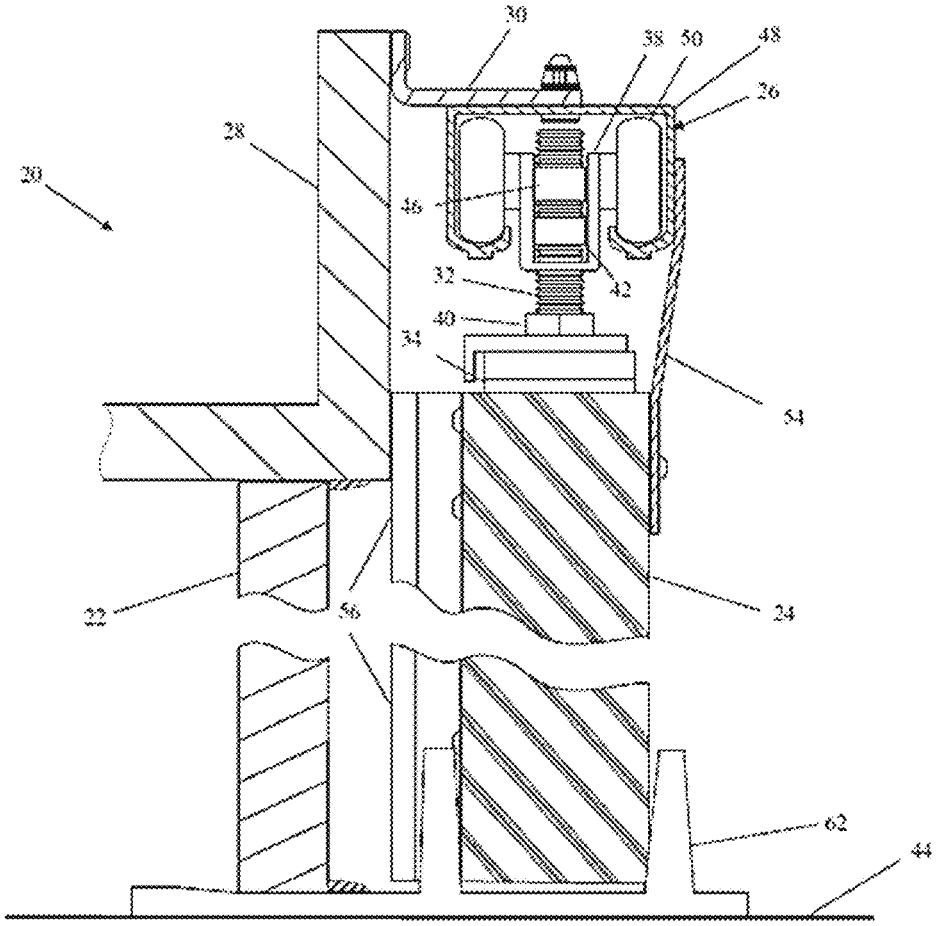
FIG. 2 is a partial cross-sectional view of the easy glide door assembly attached to the door head in front of the standard exterior door taken along line 2-2 of FIG. 1.
Figure 3:
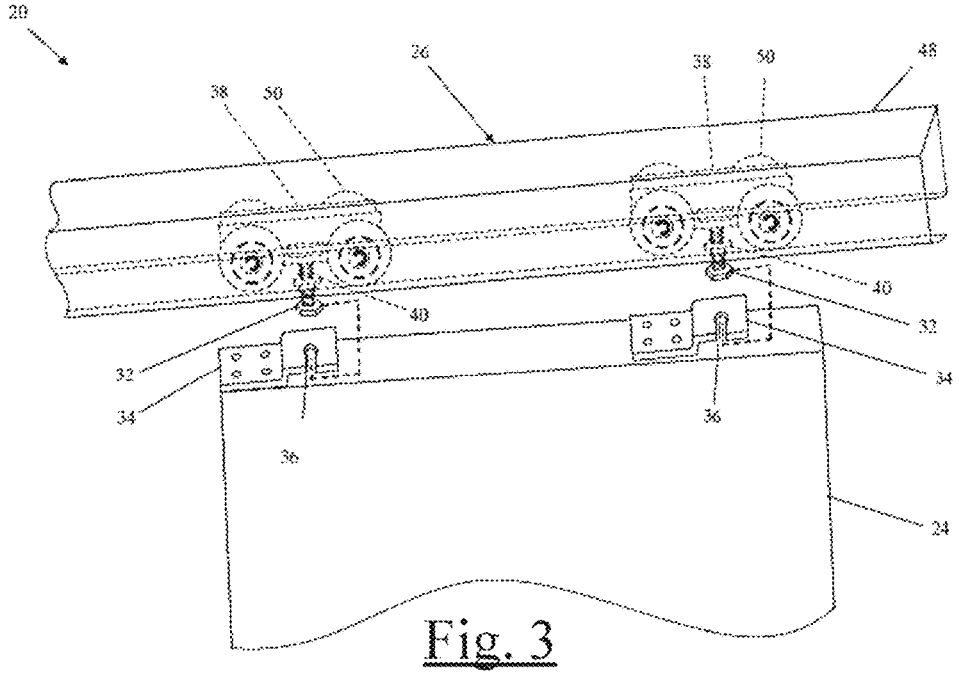
FIG. 3 is an exploded partial perspective view of the attachment of the door and the roller track system via the door bracket.
Figure 4:
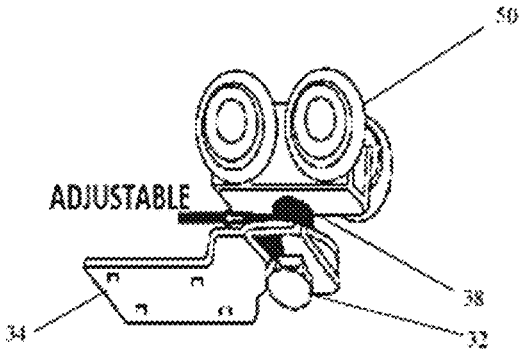
FIG. 4 is a perspective view of a door bracket and the rollers.
Figure 5:
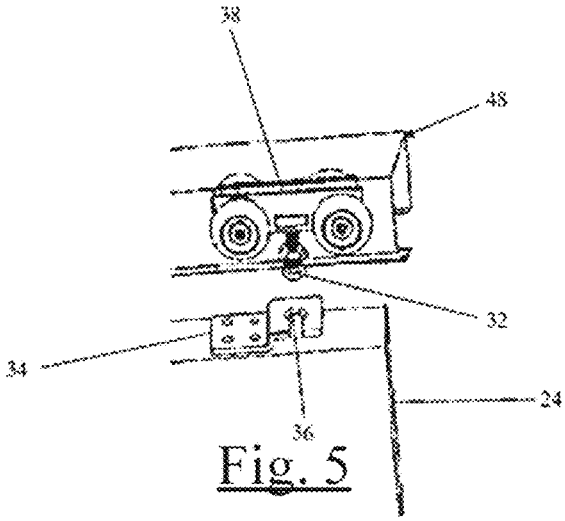
FIG. 5 is a partial perspective view of the door, the door bracket, the rollers, and the track.

FIG. 2 is a cross-sectional view taken from lines 2-2 in FIG. 1 which shows how the door 24 is installed in front of (i.e., on the exterior side of) the exterior door 22. The track system 26 is firmly attached to a door head 28 or exterior wall structure via as wall bracket 30. The wall bracket 30 could be any appropriate shape to attach the track system 26 to the door head 28. For example, an L-shaped bracket can be used to attach the track system 26 to a vertical wall, or a Z-shaped bracket to a horizontal ceiling. The door 24 is hung from a thrust bolt 32 in the track system 26 via a door bracket 34. FIG. 3 illustrates an exploded view of attachment of the door 24 and the roller track system 26 via the door bracket 34. Typically at least two door brackets 34 are firmly disposed on a top surface of the door 24. The door bracket 34 takes the form of a generally Z-shaped plate having a uglier portion and a lower portion. The lower portion of bracket 34 is firmly fixed through holes on the top surface of the door 24 by screwing, welding or other suitable means. The upper portion of bracket 34 includes a notch 36. The notch 36 is configured to hook over the head of the thrust bolt 32, and as nut 40 is generally designed to fasten the door bracket 34 and the thrust bolt 32 as shown in FIGS. 2 and 3.

Returning to again FIG. 2, a fixed bolt 42 is permanently attached to the track system 26. The height of the door 24 can be adjusted by turning the thrust bolt 32 so that the door 24 can keep appropriate gap between the bottom surface of the door 24 and a sill 44. A counter bolt 46 is located over the fixed bolt 42. When the counter bolt 46 is tightened to the fixed bolt 42, the counter bolt 46 can prevent the thrust bolt 32 from loosening and firmly maintain the height of the door 24.

Figure 6:
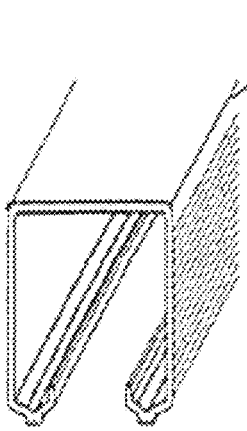
FIG. 6 is a partial perspective view of the track.
Figure 7:
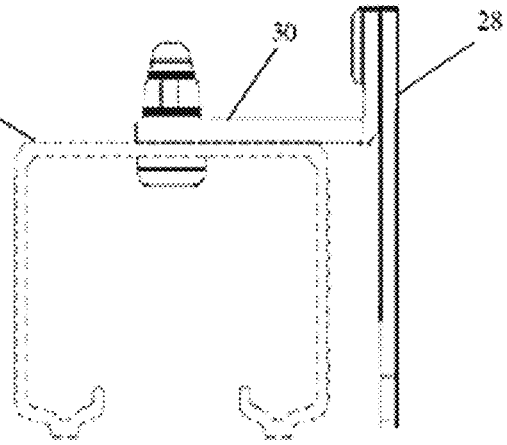
FIG. 7 is a partial side view of the track attached to the door head via the wall bracket.
Figure 8:
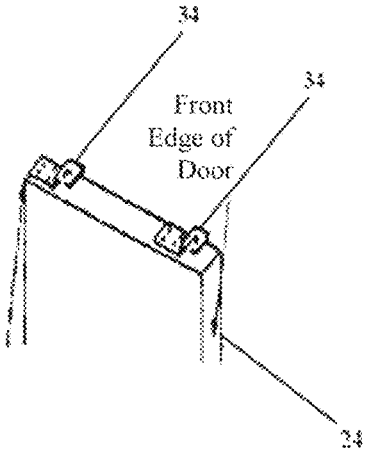
FIG. 8 is a partial perspective view of a pair of door brackets attached to the door.

FIGS. 2-7 illustrate how the track system 26 is composed to permit sliding movement of the door 24. The track system 26 generally comprises a pair of rollers 38 and a track 48. The roller 38 generally includes two pair of wheels 50, which can freely rotate on the both sides of the roller 38. The track 48 takes the form of a generally a U-shaped strut channel as shown in FIGS. 6 and 7. The rollers 38 are configured to slide inside the track 48. In both ends of channel of the track 48, a stopper 52 is disposed to prevent the roller 38 from escaping the track 48. One example of the stopper 52 could be a screw across the track 48. However, any means of preventing the roller 38 from escaping could be the stopper 52. (E.g. an end block or cap.)

Returning to FIGS. 1 and 2, a flexible top guard 54 is firmly attached to the exterior face of the door 24 adjacent its top edge. The top guard 54 extends above the door 24 and partially overlays the tack 48 to keep bugs out of the gap between the track system 26 and the door 24. Also, the top guard 54 prevents rain and dust from entering and can protect the track system 26 and the exterior door 22. The top guard is designed to closely ride against the track 48. FIGS. 1 and 2 depict a right side guard 56, which is firmly disposed along the right side edge of the door 24 to seal the gap between the door 24 and a wall. A left side guard (not illustrated) can be attached to the door 24 to accomplish a similar purpose.

Figure 9:
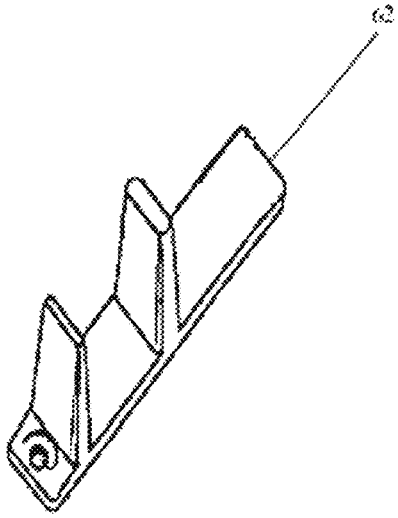
FIG. 9 is a perspective view of the lower guide.

The door assembly 20 may further include a lower guide 62 to help maintain the door 24 in a vertical orientation at all times, even when being slid open and closed. FIGS. 1, 2 and 9 show the guide 62, which is firmly fixed in the sill 44. In particular, the guide 62 includes a generally U-shape slot that confines a bottom portion of the door 24. Furthermore, the guide 62 can prevent the door 24 from shaking by gusts of wind.

The present invention also can conveniently replace with an existing prior art storm door because the door 24 can be configured to slide right or left corresponding to a pre-installed exterior door. In FIG. 1, the door 24 is configured to slide right, but, the door 24 can be configured to slide toward the left. Thus, the present invention can be easily adapted to both left and right knob door applications Many modifications and variations of the present invention are possible in light of the above teachings and may be practiced otherwise than as specifically described while within the scope of the contemplated invention.

Any numerical values recited herein include all values from the lower value to the upper value in increments of one unit provided, that there is a separation of at least 2 units between any lower value and any higher value. As an example, if it is stated that the amount of a component or a value of a process variable such as, for example, temperature, pressure, time and the like is, for example, from 1 to 90, preferably from 20 to 80, more preferably from 30 to 70, it is intended that values such as 15 to 85, 22 to 68, 43 to 51, 30 to 32 etc. are expressly enumerated in this specification. For values which are less than one, one unit is considered to be 0.0001, 0.001, 0.01 or 0.1 as appropriate. These are only examples of what is specifically intended and all possible combinations of numerical values between the lowest value and the highest value enumerated are to be considered to be expressly stated in this application in a similar manner. As can be seen, the teaching of amounts expressed as "parts by weight" herein also contemplates the same ranges expressed in terms of percent by weight. Thus, an expression in the Detailed Description of the Teachings of a range in terms of at "'x' pans by weight of the resulting polymeric blend composition" also contemplates a teaching of ranges of same recited amount of "x" in percent by weight of the resulting polymeric blend composition."

Unless otherwise stated, all ranges include both endpoints and all numbers between the endpoints. The use of "about"

or "approximately" in connection with a range applies to both ends of the range. Thus, "about 20 to 30" is intended to cover "about 20 to about 30", inclusive of at least the specified endpoints.

The disclosures of all articles and references, including patent applications and publications, are incorporated by reference for all purposes. The term "consisting essentially of" to describe a combination shall include the elements, ingredients, components or steps identified, and such other elements ingredients, components or steps that do not materially affect the basic and novel characteristics of the combination. The use of the terms "comprising" or "including" to describe combinations of elements, ingredients, components or steps herein also contemplates embodiments that consist essentially of the elements, ingredients, components or steps.

Plural elements, ingredients, components or steps can be provided by a single integrated element, ingredient, component or step. Alternatively, a single integrated element, ingredient, component or step might be divided into separate plural elements, ingredients, components or steps. The disclosure of "a" or "one" to describe an element, ingredient, component or step is not intended to foreclose additional elements, ingredients, components or steps.

It is understood that the above description is intended to be illustrative and not restrictive. Many embodiments as well as many applications besides the examples provided will be apparent to those of skill in the art upon reading the above description. The scope of the teachings should, therefore, be determined not with reference to the above description, but should instead be determined with reference to the appended claims, along with the full scope of equivalents to which such claims are entitled. The disclosures of all articles and references, including patent applications and publications, are incorporated by reference for all purposes. The omission in the following claims of any aspect of subject matter that is disclosed herein is not a disclaimer of such subject matter, nor should it be regarded that the inventors did not consider such subject matter to be part of the disclosed inventive subject matter.

The invention claimed is:

1. A method of installing a storm door, the method comprising steps of:

attaching a track to a door head, the track comprising a surface that is generally parallel to an exterior surface of the storm door;

attaching one or more rollers to the track, each of the rollers comprise a thrust bolt that hangs from a respective one of the one or more rollers;

attaching a door bracket to a top surface of the storm door, the top surface of the storm door being defined between and connecting an interior surface of the storm door and the exterior surface of the storm door, the door bracket comprises a notch, the notch has an open end located at an edge of the door bracket;

attaching a flexible top guard to the exterior surface the storm door such that the top guard extends beyond the top surface of the storm door and directly contacts the surface of the track that is generally parallel to the exterior surface of the storm door, the top guard is configured to close out a gap defined between the track and the storm door, and attaching the storm door to the one or more rollers;

wherein the step of attaching the storm door to the one or more rollers includes a step of: hooking the open end of the notch over a head of the thrust bolt of each of the one or more rollers;

wherein after the storm door is installed, the storm door can be slid along a length of the track between an open position and a closed position.

2. The method of claim 1, wherein the step of attaching the track to the door head includes a step of:

attaching a wall bracket to the door head; and attaching the track to the wall bracket;

wherein the step of attaching the track to the wall bracket is before or after the step of attaching the wall bracket to the door head.

3. The method of claim 2, wherein a length of the track is approximately 2× a width of the storm door.

4. The method of claim 1, wherein the door bracket includes a higher portion and a lower portion, wherein the lower portion is attached to the top surface of the storm door, wherein the upper portion includes the notch, wherein the upper surface is generally parallel to the lower surface, and wherein the upper portion is offset from both the lower portion and the top surface of the storm door such that after the storm door is attached to the one or more rollers, the head of the thrust bolt is located in between the upper portion of the door bracket and the top surface of the storm door.

5. The method of claim 1, wherein the method includes a step of:

adjusting a height of the storm door relative to the door head by rotating the thrust bolt.

6. The method of claim 5, wherein the step of adjusting the height of the storm door includes a step of:

tightening a counter bolt after the height of the storm door is adjusted to prevent the thrust bolt from loosening.

7. The method of claim 1, wherein the method includes steps of:

attaching a lower guide including a U-shaped channel to a bottom sill; and inserting the storm door into the U-shaped channel;

wherein the storm door slides within the U-shaped channel when the storm door is slid between the open position and the closed position.

8. The method of claim 1, wherein the method includes a step of:

installing the storm door in front of an exterior door.

9. The method of claim 1, wherein the open end of the notch is oriented generally perpendicular to a direction that the storm door is slid between the open position and the closed position.

10. A method comprising:

attaching a wall bracket to a door head;

attaching a track to the wall bracket;

attaching one or more rollers to the track;

attaching a door bracket on top of a top surface of a door, the top surface of the door being defined between and connecting an interior surface of the door and an exterior surface of the door, the door bracket is generally Z-shaped and comprises a higher portion and a lower portion, the higher portion comprises a notch, the lower portion is attached to the top surface of the door so that the upper portion is spaced apart from the top surface of the door;

attaching the door bracket to the one or more rollers by hooking the notch over a thrust bolt located on each of the one or more rollers such that a head of the thrust bolt is located between the top surface of the door and the upper portion of the door bracket; and attaching a flexible top guard to the exterior surface of the storm door, the top guard extends above the top surface of the door and directly contacts the track.

11. The method of claim 10, wherein a length of the track is approximately twice a width of the door, the track comprising a generally U-shaped cross section so that the one or more rollers slide within the track, and wherein the method includes a step of attaching a stopper at both ends of the track to prevent the rollers from escaping the track.

12. The method of claim 11, wherein the method includes a step of:

attaching a lower guide to a bottom sill, and wherein a length of the lower guide is approximate twice the width of the door, and wherein the lower guide comprises a generally U-shaped slot that confines a bottom portion of the door so that the door is maintained in a vertical orientation when being slid between the open position and the closed position.

13. The method of claim 10, wherein the method includes a step of:

removing the door from a wall before the step of attaching the door bracket to the one or more rollers, wherein before the removing step, the door is adapted to swing along an arc between an open position and a closed position, and wherein after the door bracket is attached to the one or more rollers, the door can be slid along a length of the track between the open position and the closed position.

14. The method of claim 10, wherein the method includes a step of installing the door in front of an exterior door.

15. The method of claim 10, wherein the method includes a step of adjusting a height of the door relative to the door head by rotating the thrust bolt, and then tightening a counter bolt after the height of the door is adjusted to prevent the thrust bolt from loosening, wherein the counter bolt is tightened to a fixed bolt to prevent the thrust bolt from loosening the fixed bolt is fixed to a track of the one or more rollers.

16. The method of claim 10, wherein the top guard is configured to directly contact a surface of the track that is generally parallel to the exterior surface the storm door.

17. The method of claim 10, wherein the notch comprises an open end, the open end is oriented generally perpendicular to a direction that the storm door is configured to be moved.

18. A method comprising steps of:

attaching a wall bracket having an L-shape to a front surface of a door head;

attaching a track to a bottom surface of the wall bracket, a length of the track is approximately twice a width of the storm door;

attaching a pair of rollers to the track, each of the rollers includes two pair of wheels, which are adapted to rotate inside the track;

attaching a pair of door brackets onto a top surface of a storm door, the top surface is located between and connects an interior surface of the storm door and an exterior surface of the storm door, the top surface is generally perpendicular to both the interior surface and the exterior surface, each of the door brackets include a lower portion and an upper portion such that each of the door brackets have are generally Z-shaped, the upper portion is generally parallel to the lower portion, the upper portion comprises a notch that has an open end located at an surface of the upper portion, the open end of the notch is oriented generally perpendicular to a direction that the storm door is slid between an open position and a closed position, the notch is generally U-shaped;

attaching the upper portion of each of the door brackets to a corresponding one of the rollers by hooking the open end of the notches over corresponding thrust bolts located on each of the one or more rollers such that a head of each of the thrust bolts is located in between the upper portion of the door brackets and the top surface of the storm door;

attaching a stopper at both ends of the track to prevent the rollers from escaping the track;

attaching a lower guide to a bottom sill, the lower guide comprises a generally U-shaped slot that confines a bottom portion of the storm door so that the storm door is maintained in a vertical orientation when being slid between the open position and the closed position;

attaching a flexible top guard to the exterior surface of storm door, the top guard extends above the storm door and partially overlays the track such that the top guard directly contacts a surface of the track that is generally parallel to the exterior surface of the storm door, the flexible top guard is configured to closes out a gap defined between the track and the storm door;

wherein after the storm door is attached to the rollers, the storm door can be slid along the length of the track between the open position and the closed position, and wherein the top guard is adapted to ride along the track when the storm door is slid along the length of the track between the open position and the closed position while maintaining contact with the surface of the track.

19. The method of claim 18, wherein the method includes a step of adjusting a height of the storm door relative to the door head by rotating the thrust bolt, and then tightening a counter bolt after the height of the storm door is adjusted to prevent the thrust bolt from loosening.

20. The method of claim 18, wherein the method includes a step of removing the storm door from a wall, wherein before the removing step, the storm door is adapted to swing along an arc between an open position and a closed position, and after the storm door is attached to rollers, the storm door is restricted from swinging along the arc.

* * * * *